US005169441A

United States Patent [19]

Lauzon

[11] Patent Number: 5,169,441

[45] Date of Patent: Dec. 8, 1992

[54] CATIONIC DISPERSION AND PROCESS FOR CATIONIZING FINELY DIVIDED PARTICULATE MATTER

[75] Inventor: Rodrigue V. Lauzon, Hockessin, Del.

[73] Assignee: Hercules Incorporated, Wilmington, Del.

[21] Appl. No.: 629,328

[22] Filed: Dec. 17, 1990

[51] Int. Cl.[5] ..... C09D 17/00; C04B 33/18

[52] U.S. Cl. ..... 106/416; 106/448; 106/465; 106/487; 501/146; 501/148

[58] Field of Search ..... 501/146, 148; 106/416, 106/448, 465, 487

[56] References Cited

U.S. PATENT DOCUMENTS

| | | | |
|---|---|---|---|
| 3,804,656 | 4/1974 | Kaliski et al. | 106/308 Q |
| 4,294,885 | 10/1981 | Sundén | 428/404 |
| 4,801,403 | 1/1989 | Lu et al. | 106/DIG. 3 |
| 4,874,466 | 10/1989 | Savino | 162/164.3 |
| 5,006,574 | 4/1991 | Sennett et al. | 106/286.5 |

FOREIGN PATENT DOCUMENTS 382427 8/1990 European Pat. Off. .

OTHER PUBLICATIONS von Raven, Strittmatter, Weigel, "Cationic Coating Colors—A New Coating System", *Tappi*, Dec. 1988, pp. 141-148.

Chem. Abstract, 112:38499p.

Weigl, J., Breunig, A., Weiss, O., "Use of Pretreated Fillers in Paper-making and Their Influence on Paper Properties", *Institute of Paper Chemistry*, Translated from Wochbl. Papierfabr. 109, No. 4:103-110, 112 (Feb. 28, 1981).

Alince, B., "Deposition of Cationic Polymeric Pigments on Pulp Fibers", *J. Colloid and Interface Science*, vol. 69, No. 3, pp. 367-374, May 1979.

Weigl et al., "Use of Pretreated Filler in Papermaking and Their Influence of Paper Properties".

*Primary Examiner*—William R. Dixon, Jr.
*Assistant Examiner*—C. Melissa Bonner
*Attorney, Agent, or Firm*—Roslyn T. Tobe; Roy V. Jackson

[57] ABSTRACT

Fillers and pigments, such as clay, titanium dioxide, calcium carbonate, silicas, and silicoaluminates, can be rendered cationic by treating the fillers or pigments with the reaction product of a polyamine or polyamide and epichlorohydrin. The resulting water soluble cationic fillers or pigments are useful in the paper industry as fillers for paper and can also be utilized in coating paper.

43 Claims, 6 Drawing Sheets

Klondyke Clay Breakover

Rutile $TiO_2$ Breakover

Hydracarb Breakover
Viscosity (cp)
Zeta Potential (mv)
300
250
200
150
100
50
30
20
10
0
-10
-20
-30
-40
0
0.2
0.4
0.6
0.8
1
mls of Polymer A (38% solids)

Bentonite Clay Breakover
Viscosity (cp)
Zeta Potential (mv)
viscosity
Z.P.
100
80
60
40
20
20
0
-20
-40
0
2
4
6
8
% Polymer A based on bentonite Hydrafine Clay Breakover
Viscosity (cp)
300
250
200
150
100
50
0
0.02
0.04
0.06
0.08
0.1
mls Polymer A (38%)/g of clay Kaolin with Polymer D

CATIONIC DISPERSION AND PROCESS FOR CATIONIZING FINELY DIVIDED PARTICULATE MATTER

Background of the Invention

This invention relates to a modification of the surface of finely divided particulate matter such that it has a stronger affinity for cellulose fibers. More specifically, the invention involves the charge reversal of finely divided pigments and fillers such as clay, titanium dioxide, calcium carbonate, silicas and silicoaluminates by treating these fillers and pigments with a water soluble cationic polyamide resin.

These fillers and/or pigments are typically used in the papermaking industry to improve the optical and physical properties of the sheet. In some instances, the cost of manufacturing the paper will decrease because the fillers are often less costly than the fiber.

The introduction of fillers and/or pigments by wet-end addition (before a sheet is formed) requires their effective deposition on fibers suspended in water. Since most of the fillers and/or pigments are negatively charged, they do not deposit on the similarly charged pulp fibers without the addition of some retention aids and careful process control. The deposition of these fillers and pigments is enhanced if the fillers or pigments are rendered cationic.

These fillers or pigments can be rendered cationic by various standard techniques including utilizing inorganic salts, cationic surfactants, natural polymers, and polyethylenimine.

While capable of rendering the fillers or pigments cationic, these techniques can deleteriously affect the characteristics of the fillers or pigments. Some of the characteristics affected include wetting properties of the filler material, foaming tendency, wet strength, dry strength, ink penetration, and sizing. Another disadvantage of these methods can be that the filler or pigment will only retain its cationic character over a narrow pH range.

Polyethyleneimine has been used most often to render fillers and pigments cationic. The cationic charge on polyethyleneimine is high at low pH and becomes much less substantial at higher pH. Treating a filler or pigment with such a weak polymer will render the filler or pigment cationic at low pH while at high pH the charge will return to that of the mineral's surface. Many times this causes the mineral to be amphoteric rather than truly and strongly cationic.

U.S. Pat. No. 3,804,656 discloses a process for making cationic clays and other fillers utilizing a combination of nonionic and cationic surface active agents in conjunction with a strong base. The patent notes at column 2, lines 52–54, that cationic surfactants used alone are incapable of providing predispersed aqueous pigment suspensions having suitable rheological properties. In addition to requiring the use of a nonionic surfactant, the patent also requires the presence of a strong base. In contrast, the present invention utilizes only a cationic dispersant and does not require the presence of a strong base.

An article by von Raven, Strittmatter and Weigl in Tappi, J. Dec. 1988) pp. 141–148, entitled "Cationic Coating Colors-A New Coating System" describes a method for producing cationic coating pigments such as $CaCO_3$, kaolin, and talcum at relatively high solids by utilizing cationic dispersing agents such as quaternary ammonium compounds; polyamine-amide fatty acids compounds, and highly degraded cationic galactomannans of low molecular weight.

Chem Abstract 112:38499p discloses cationic polymers obtained from a polyethylene glycol polyhalohydrin ether by the reaction with 0.1 to 10,000 parts aziridine compounds and polyamines mixed with pigment for use as paper coating.

Neither the von Raven article nor the Chem Abstract reference disclose the specific polymers containing cyclic quaternary functional groups as utilized in the present invention.

U.S. Pat. 4,874,466 discloses a papermaking filler composition comprising a pigment, preferably titanium dioxide, and a cationic water soluble polymer selected from the group consisting of polymers comprised of at least 50% by weight of repeating units consisting of a quaternary ammonium salt moiety and from 2 to 10 carbon atoms, wherein the carbon atoms form alkyl or aryl moieties or combinations of alkyl and aryl moieties which may be substituted with hydroxy amine or halide, and polyaluminum chloride and mixtures thereof. This treatment imparts a positive charge to the titanium dioxide. The patent does not disclose the use of other materials such as clays or silicoaluminates.

European Patent Application 382427A2 filed on Feb. 2, 1990, discloses a stable fluid acidic slurry comprising particles of calcined kaolin containing a dispersant of a water soluble cationic quaternary ammonium polymer salt in an amount imparting a positive zeta potential to the pigment. The use of quaternary ammonium cationic polyelectrolytes obtained by copolymerizing aliphatic secondary amines with epichlorohydrin is disclosed. This reference does not utilize the same type of fillers or pigments as the present invention.

Accordingly, some of the objects of this invention are to be able to render fillers and pigments cationic at high solids concentrations, maintain a cationic zeta potential throughout all applicable pH values, and provide fillers and pigments which have enhanced retention on the fibers in a cost effective manner.

DESCRIPTION OF THE INVENTION

Figure 1:
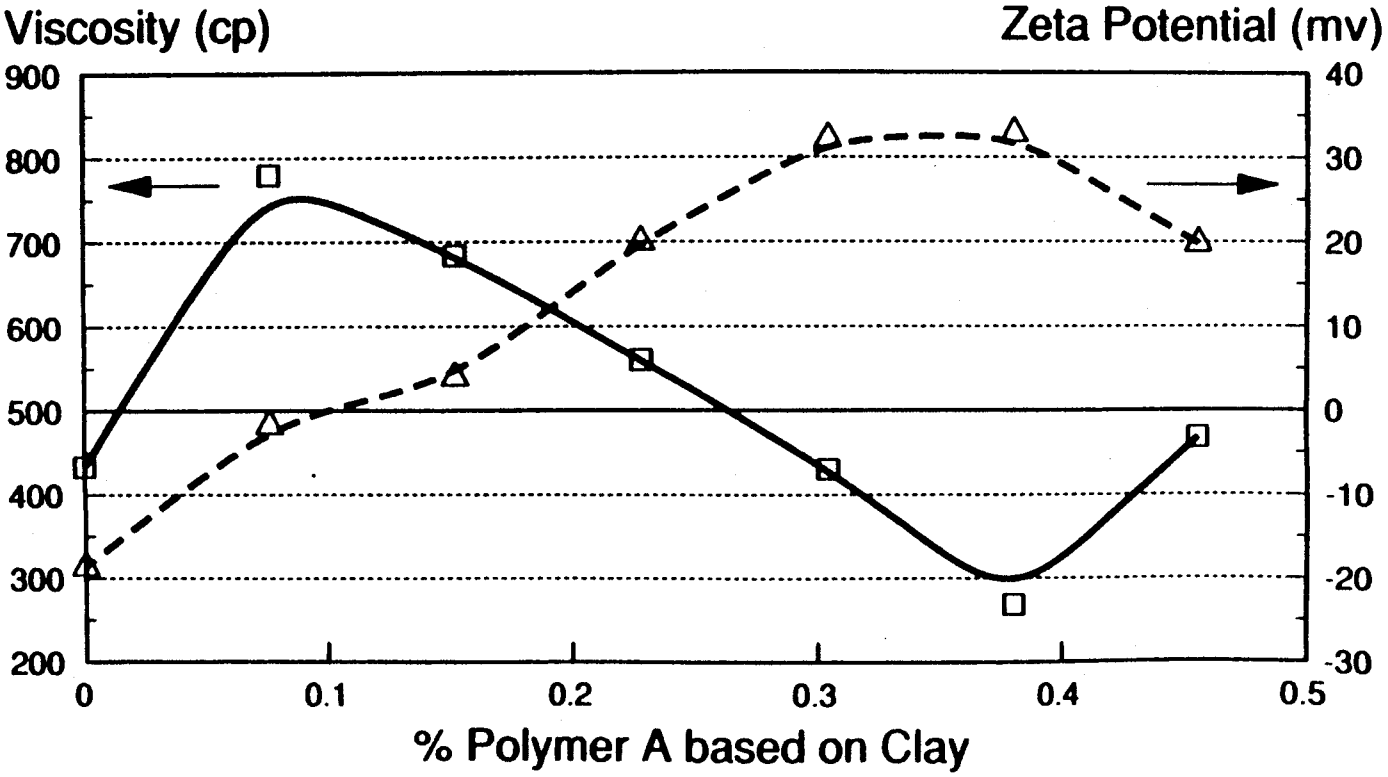
FIG. 1 shows the breakover curve and zeta potential curve for Klondyke clay treated with Polymer A.

The present invention involves the charge reversal of finely divided pigments and fillers such as clays, $TiO_2$, $CaCO_3$, silicas, and silicoaluminates. This is accomplished by adsorbing water soluble cationic polyelectrolyte polymers at the filler/pigment solution interface.

In general, cationic water soluble polymers composed of the reaction product of epichlorohydrin and compounds containing cyclic quaternary functional groups are suitable for use in effecting the charge reversal of the present invention. These cyclic groups can be four-membered azetidinium ions containing the structure

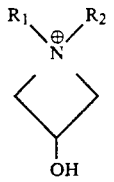

where $R_1$ and $R_2$ are residues of the polymer chain, or can be five-membered cyclic quaternary ions having the structure

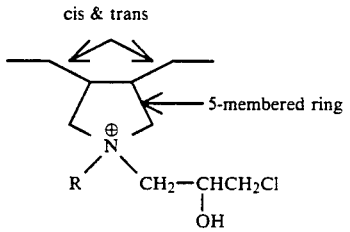

where R is a $C_1$ to $C_5$ alkyl group.

Preferably, R is a $C_1$ to $C_3$ alkyl group. It is thought that 30 to 80% cyclic quaternary groups will be effective for cationizing fillers and pigments. Preferably the compound has 50 to 80% cyclic quaternary groups. Examples of the cationic polymers used in the present invention are: (1) the reaction product of methyldiallylamine and epichlorohydrin; and (2) the reaction product of a polyalkylene amine compound such as bis(hexamethylenetriamine) (BHMT) and epichlorohydrin. The cationic polymers used in the examples which follow are described below:

Polymer A-the reaction product of BHMT and epichlorohydrin.

Polymer B-the reaction product of epichlorohydrin and an aminopolyamide derived from adipic acid and diethylenetriamine Polymer C-the reaction product of a condensate derived from the reaction of diethylenetriamine, and cyanoguanidine, then reacted with epichlorohydrin.

Polymer D-the reaction product of methyldiallylamine and epichlorohydrin.

In accordance with the present invention, a 20 to 60 wt. % solids cationic filler dispersion is prepared as follows:

1. disperse the cationic polymer in an appropriate amount of water,
2. stir the mixture for about 2 minutes using an electric stirrer with a Cowles blade,
3. sprinkle filler into mixture while stirring until the appropriate amount of filler has been added,
4. allow the dispersion to stir for about 30 minutes after all the filler has been added,
5. measure the viscosity and/or zeta potential. The cationic polymer is present in the amount of from about 0.1 to 8 wt. % based on the pigment of filler.

The magnitude and sign (positive or negative) of the electrical charge on the particles cited in the examples and elsewhere herein are measured using the Lazer Zee meter, Model 501, a product of Pen Kem, Inc. The measurement involves the determination of the velocity of migration of charged particles under a known potential gradient. The measurement is carried out in a dilute suspension of the slurry. From the measured electrophoretic velocity, the particle charge (zeta potential) can be calculated. Cationic and anionic particles migrate in opposite direction at velocities proportional to the charge. Other methods of measuring the magnitude and sign of the electrical charge on the particles can be used.

Typically when concentrated anionic dispersions of fillers are titrated with a cationic polymer, as described above, the viscosity will increase drastically. If the molecular weight of the cationic polymer is not too high and it functions as a dispersant, further addition of the cationic polymer may reduce the viscosity to produce a "redispersed system". This curve of viscosity vs. concentration of cationic polymer will usually have a high maximum viscosity which occurs in the range of the point of zero charge when the particles have their charge neutralized. Once the particles begin to show a positive charge, the viscosity also begins to decrease due to redispersion. This viscosity curve has been termed a "breakover" curve. Examples of these breakover curves are illustrated by FIGS. 1 to 6.

The following examples illustrate the present invention.

EXAMPLE 1

A kaolin type clay known as Klondyke clay is treated with the reaction product of bis(hexamethylenetriamine) and epichlorohydrin (Polymer A). Klondyke clay is normally used as a filler clay and has a larger particle size than clay used for paper coatings.

The Klondyke clay is treated as follows with Polymer A to make it cationic:

a) 30 g of Klondyke clay is dispersed in 100 ml of water, b) 0 to 0.7% of Polymer A per unit weight of clay is added incrementally, c) the dispersion is stirred for about 30 minutes.

Viscosity and zeta potential measurements were made at this point.

FIG. 1 shows the breakover curve (solid curve) and the zeta potential curve (dashed curve) for Klondyke clay. The breakover curve goes through a breakover maximum and then the viscosity decreases. The Klondyke clay is dispersed at about 29% solids. Aliquots were taken periodically and diluted to measure the zeta potential. The dashed curve of FIG. 1 shows zeta potential measurements which have been made on diluted aliquots from the concentrated samples used for the breakover curve.

In the first part of the breakover curve, the viscosity is increasing while the negative zeta potential is tending toward zero. The maximum viscosity occurs close to the point of zero charge. Past this point redispersion begins to occur and the viscosity decreases again. At about 0.5 mls of Polymer A, the viscosity is minimal and the zeta potential is greatest. This is the point of maximum dispersion. At this point, the viscosity is lower than the initial viscosity.

EXAMPLE 2

$TiO_2$ is made cationic by treatment with the polymers in accordance with the present invention. Rutile $TiO_2$ is treated with Polymer A as follows:

a) 30 g of Rutile $TiO_2$ are dispersed in 100 ml of water, b) 0 to 0.4% of Polymer A per unit weight of clay is added incrementally, c) the dispersion is stirred for about 30 minutes.

The viscosity is measured and a breakover curve generated.

Figure 2:
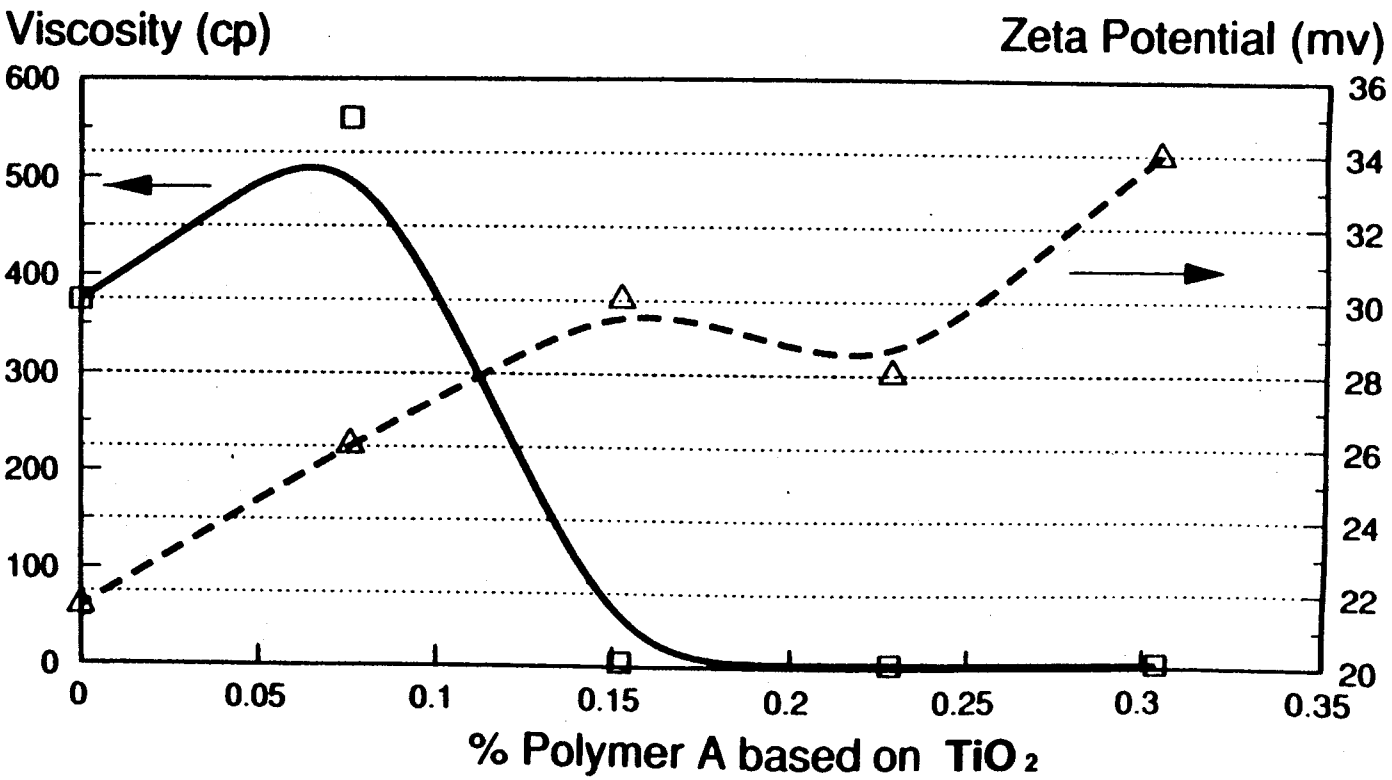
FIG. 2 shows the breakover curve and zeta potential curve for Rutile $TiO_2$ treated with Polymer A.

FIG. 2 shows the breakover curve (solid curve) and the zeta potential curve (dashed curve) for Rutile $TiO_2$. The viscosity of the final dispersion is much lower than the initially dispersed material. This suggests that very highly concentrated slurries of $TiO_2$ may be possible by using Polymer A. Cationic $TiO_2$ has increased retention and enhanced opacifying efficiency.

EXAMPLE 3

Figure 3:
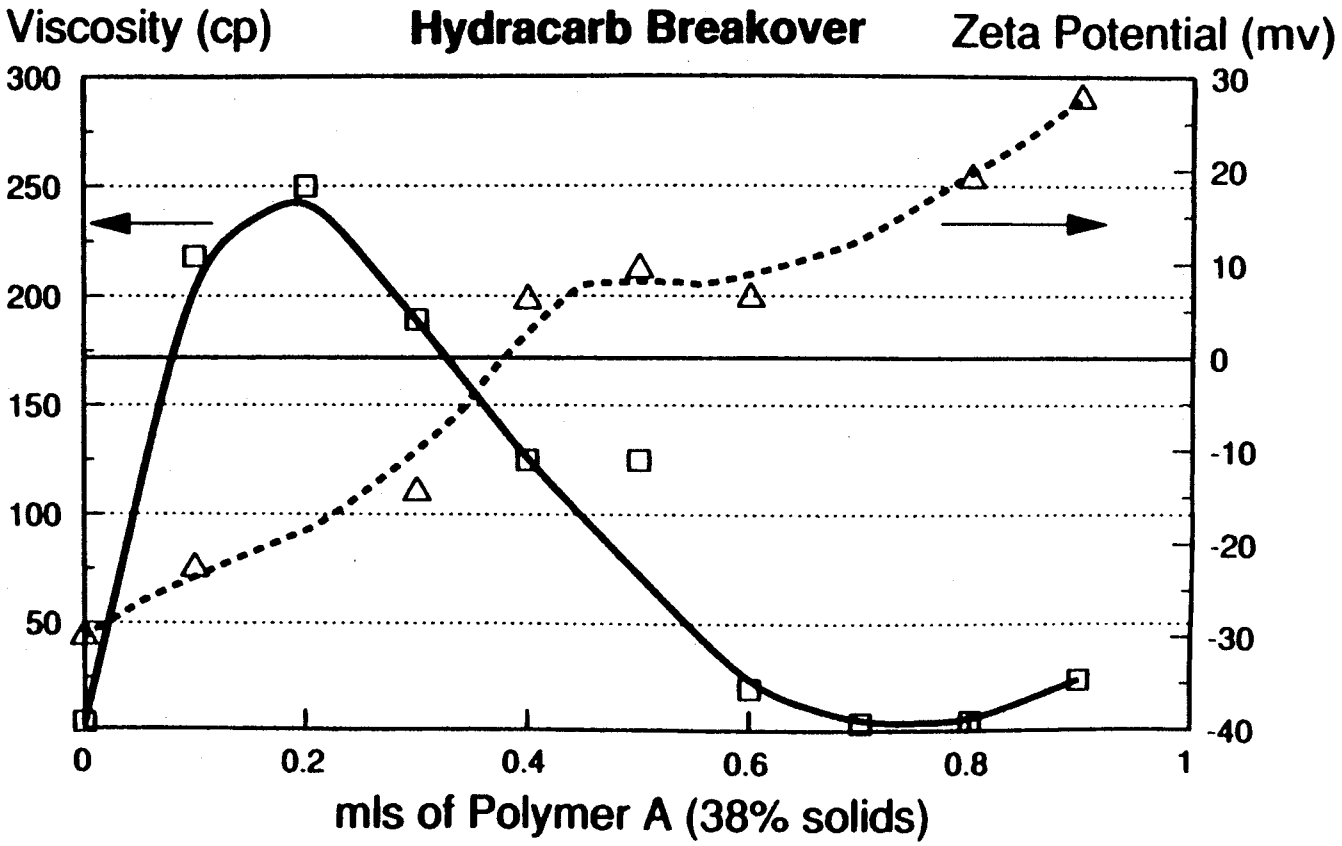
FIG. 3 shows the breakover curve and zeta potential curve for $CaCO_3$, treated with Polymer A.

FIG. 3 shows the breakover curve (solid curve) and the zeta potential curve (dashed curve) for a commercially available $CaCO_3$ paper filler sold by OMYA, Inc. under the trade name Hydracarb. The Hydracarb is treated with Polymer A and is prepared in a similar fashion to Examples 1 and 2. 30 g of Hydracarb is dispersed in 100 ml of water and stirred. 0 to 0.7% of Polymer A per unit of Hydracarb was added incrementally. The viscosity is then measured. The curve shows a typical breakover. Complete redispersion seems to occur at about 0.6 ml (0.5%) or greater.

As shown by Examples 1 to 3, the present invention can be utilized to render inorganic particles cationic. Some of the uses for these cationic particles are in paper coatings, fillers and pigments.

EXAMPLE 4

This example illustrates the cationic character of treated kaolin over an acid to alkaline pH range. A 10% dispersion of kaolin clay, a low ion exchange capacity clay which does not swell much in water, is dispersed by ultrasonication in water at neutral pH. The zeta potential is measured with a Lazer Zee Meter® as previously described. Untreated kaolin had a zeta potential of −31 mvolts. After treatment of the kaolin dispersion with the cationic polymers the charge reversal shown in Table 1 was observed.

TABLE 1

| Polymer | % Treated | pH | Zeta Potential (m volts) |
|---|---|---|---|
| A | 5% | 4.1 | +63 |
| | | 6.1 | +56 |
| | | 9.0 | +53 |
| B[1] | 5% | 4.1 | +63 |
| | | 6.0 | +51 |
| | | 9.3 | +37 |
| C[2] | 15% | 4.1 | +63 |
| | | 6.0 | +65 |
| | | 8.9 | +54 |

As the results indicate, polymers A and C are quite stable at about pH 4 to about pH 9. Polymers A and C preserve much of their charge at high pH whereas polymer B has many weak amine groups, consequently its zeta potential drops at high pH.

EXAMPLE 5

Bentonite is an example of a high ion exchange capacity clay. It is classified in the montmorillonite family. Bentonite, especially in the sodium exchanged form, swells dramatically in water. When this is allowed to occur, it is very difficult to neutralize the charge by adsorbing an ionic species. It would therefore be even more difficult to reverse the charge of bentonite especially after the clay is hydrated.

A cationic bentonite slurry at 2% solids is prepared by conventional means. Polymer A is added to the clay suspension in increments; at each addition, the suspension is stirred for 10 minutes and the viscosity and zeta potential are measured. The results are shown in Table 2.

TABLE 2

| Polymer A/Clay | Viscosity @ 20 rpm | Z.P., mv |
|---|---|---|
| no Polymer A | 25 | −38.9 |
| 0.0095/g.clay | 30 | −23.6 |
| 0.019/ | 110 | −11.4 |
| 0.038/ | 82 | +8.9 |
| 0.057/ | 78 | +21.2 |
| 0.076/ | 12 | +30.2 |

When Polymer A was added to the water before the addition of the clay, the clay would not disperse, instead it would settle out. A redispersed, cationic form of bentonite is achieved at 0.076 g Polymer A/g clay or 7.6%.

Figure 4:
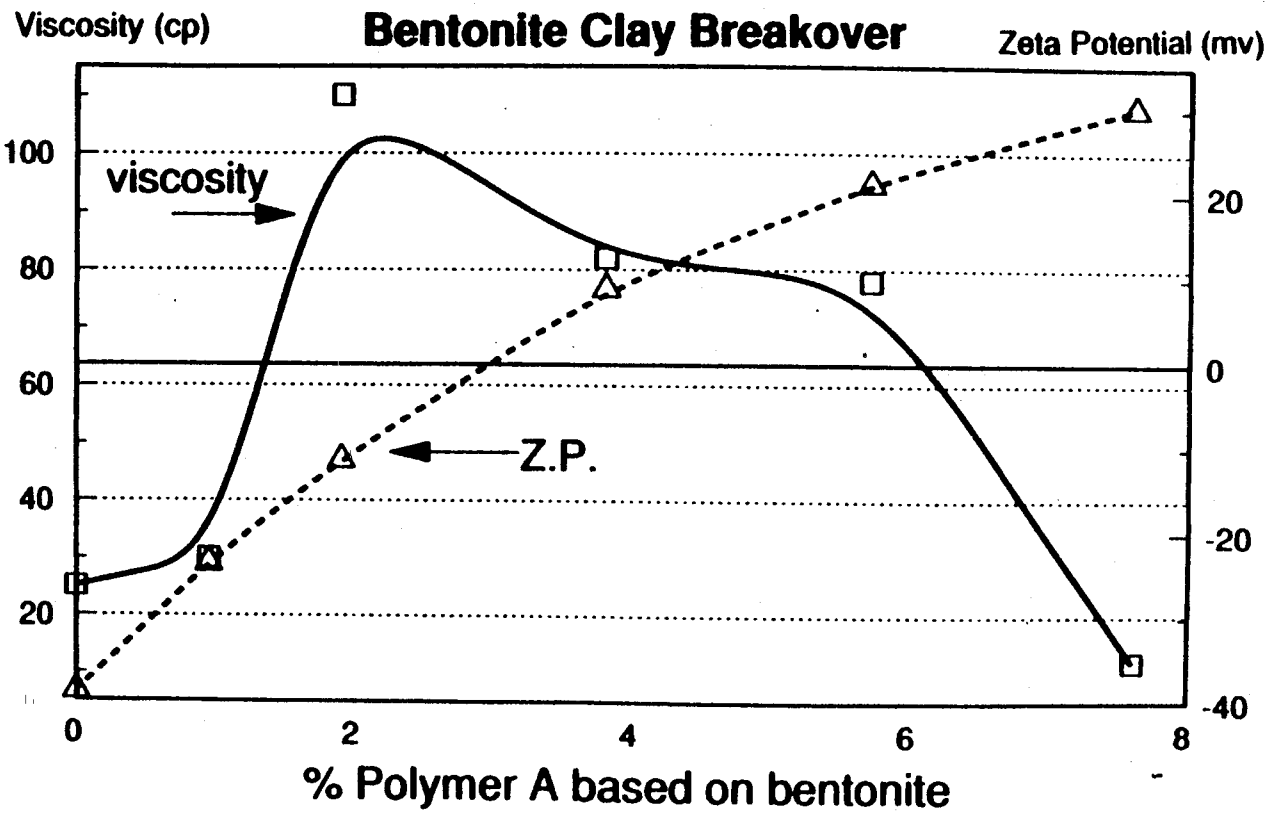
FIG. 4 shows the breakover curve and zeta potential curve for bentonite clay, treated with Polymer A.

The breakover (solid curve) and zeta potential (dashed curve) curves are shown in FIG. 4.

The cationic bentonite is then used as a filler in a newsprint handsheet experiment at a 3% loading. Table 3 illustrates the properties of the newsprint when cationic bentonite is used as a filler.

TABLE 3

| Sample | Filler Retained | Brightness | Opacity | Dry Tensile | Wet Tensile |
|---|---|---|---|---|---|
| Control (Newsprint) | | 48.7 | 67.1 | 11.1 | 0.52 |
| bentonite | 84.3% | 48.4 | 68.5 | 4.8 | 0.30 |
| cationic bentonite | 93.8% | 48.2 | 67.7 | 11.7 | 0.55 |

The retention is increased and the tensile properties were returned. Actually, the tensile properties were enhanced which is the opposite of what is expected when any filler is used.

Cationic bentonites may also be useful as scavengers for anionic trash and as microparticulate retention aids.

EXAMPLE 6

A cationic paper coating is formulated by rendering the coating pigment cationic and using a cationic viscosifier binder. Hydrafine clay, a conventional coating clay having a particle size of 90 to 92 wt. % less than 2 microns available from J. M. Huber Corporation, Clay Division, is treated as follows to make it cationic.

132 g of Hydrafine clay is added to 510 g of water and stirred with a Caframo stirrer equipped with a Cowles blade. After all the clay is added, 18 g of Polymer A (38% solids) is added to the slurry and mixed for 10 minutes. The clay Polymer A slurry is centrifuged for 30 minutes at 2500 rpm and the supernatant is decanted. The centrifugate is dried in an oven at 105° C. for 4 hours. The sample is then cooled and ground with a mortar and pestle. This dried clay is then used to prepare a 60% solids dispersion (120 g of Polymer A treated clay in 80 g of distilled water).

The treated clay is then made into a cationic paper coating as follows.

Eight parts Staley J-4 starch/100 parts clay are added to the Hydrafine clay slurry to obtain a Brookfield viscosity of 2000 cps at 100 rpm (used spindle #6). An aliquot of the coating is diluted to take a zeta potential measurement on a Lazer Zee Meter, model 501. The zeta potential is measured as +40.9 mvolts, indicating a highly cationic character.

Figure 5:
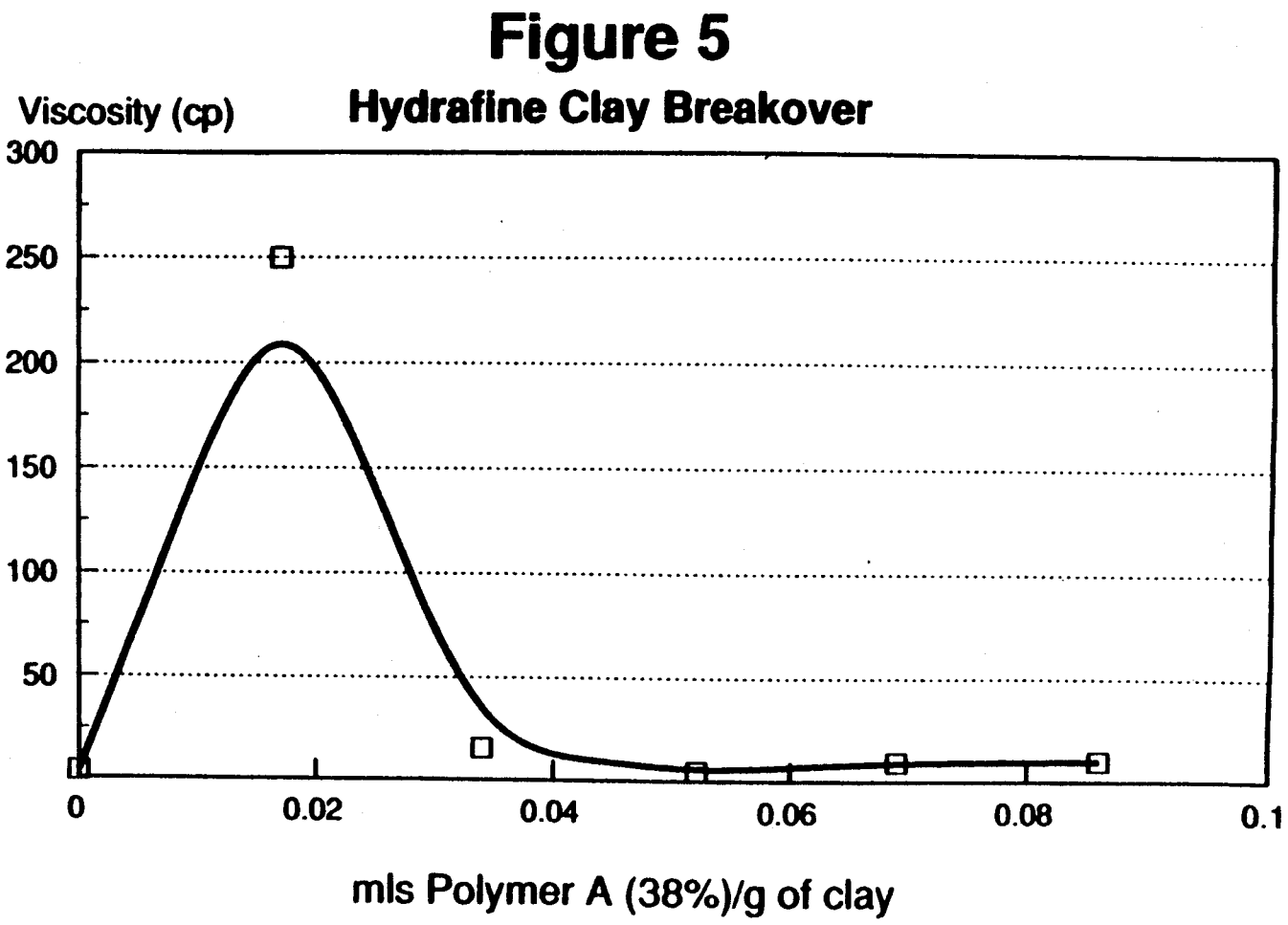
FIG. 5 shows the breakover curve for Hydrafine clay treated with Polymer A.

The breakover curve is shown in FIG. 5.

EXAMPLE 7

A measured amount of silica or silicate pigment is added, with stirring, to distilled water to form a certain solids content dispersion as shown in Table 4. The dispersions are stirred for 30 minutes. Polymer A is incrementally added to the pigment dispersion. At each addition, the dispersion is stirred for 10 minutes and the zeta potential is measured. The silica or silicate shown by trade name in Table 4 are commercially available from the J. M. Huber Corporation. They are all synthetic amorphous precipitated silicas or silicates. Zeofree 80 is silicon dioxide, Hydrex and Huberfil 96 are sodium magnesium aluminosilicates, and Hysnap is sodium magnesium alumino and aluminum silicate.

TABLE 4

| Silica or Silicate | Wt. % of Wt. of Polymer/Pigment | Z.P., mv. | % Solids |
|---|---|---|---|
| Zeofree 80 | 0 | −25.1 | 10 |
| | 0.56% | 0 | |
| | 0.76 | +14.4 | |
| | 7.6 | +25.6 | |
| Huberfil 96 | 0 | +8.1 | 20 |
| | 0.21% | +21.1 | |
| Hydrex | 0 | −34.5 | 20 |
| | 0.84% | 0 | |
| | 1.14 | −10.8 | |
| | 1.67 | +21.2 | |
| Hysnap 943 | 0 | −25.3 | 20 |
| | 0.61% | 0 | |
| | 0.85 | +12.7 | |
| | 1.06 | +23.4 | |

Treatments needed to achieve +20 to +25 may vary from 0.2% to 7.6%. Most treatments are less than 2%.

Zeolex 23P® is a commercially available sodium aluminosilicate from J. M. Huber Corporation which can also be rendered cationic with Polymer A. When this is used in newsprint at 3% loading as a filler, the opacity and the wet tensile are enhanced as shown in Table 5.

TABLE 5

| Sample | % Ash | Brightness | Opacity | Dry Tensile | Wet Tensile |
|---|---|---|---|---|---|
| Control (newsprint) | 0.58 | 48.7 | 67.1 | 11.1 | 0.52 |
| Zeolex 23P | 1.57 | 49.4 | 68.0 | 11.8 | 0.54 |
| cationic Zeolex 23P | 1.59 | 49.1 | 69.0 | 11.8 | 0.65 |

EXAMPLE 8

Figure 6:
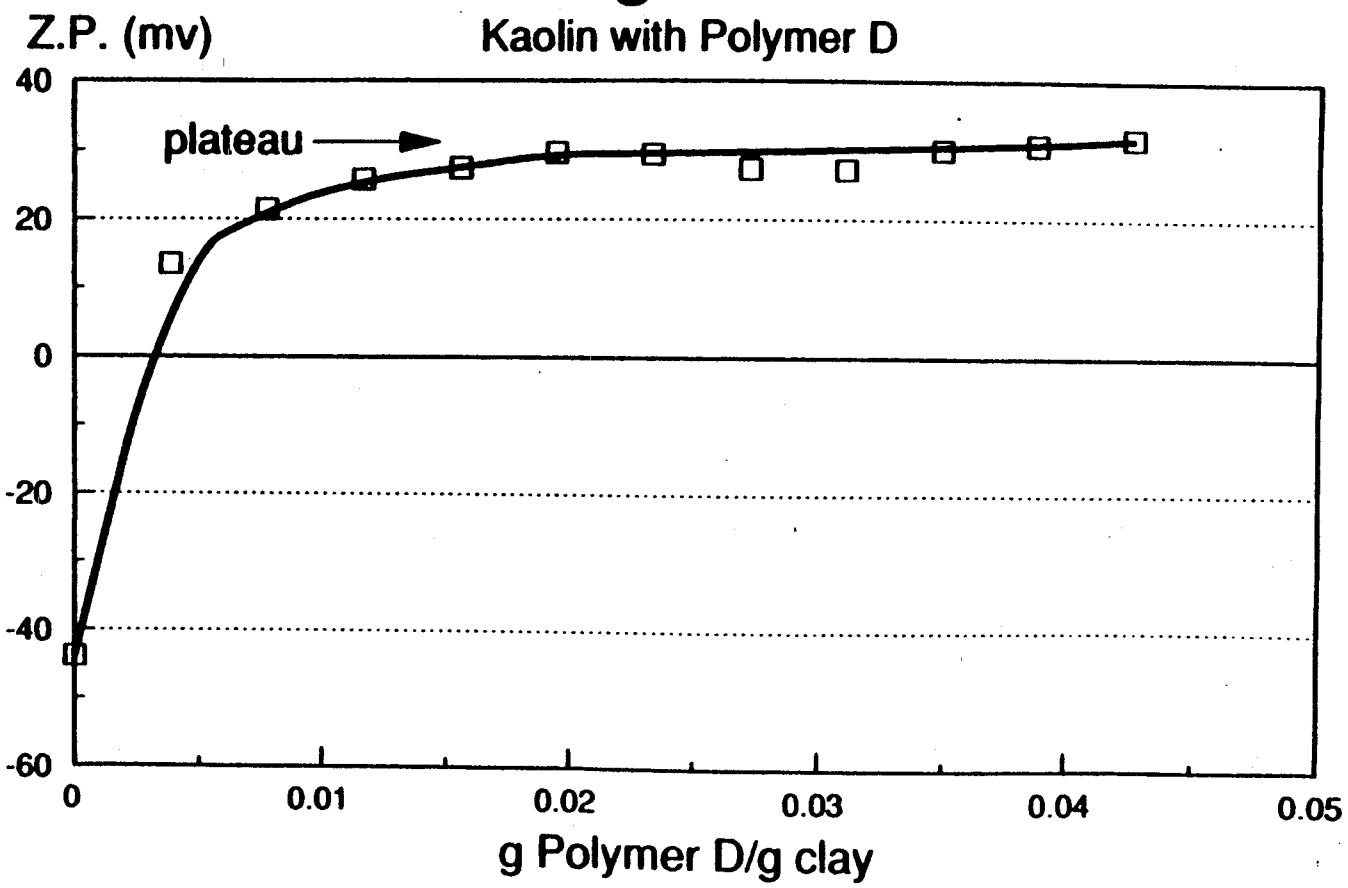
FIG. 6 shows the breakover curve and zeta potential curve for Klondyke clay treated with Polymer D.

This example illustrates the cationization of a Kaolin type clay with the reaction product of methyldiallylamine and epichlorohydrin (Polymer D). A clay slurry having a final concentration of 50% solids is prepared and treated as described in example 1 with the amount of Polymer D shown in Table 6 below. The zeta potential of each sample is determined and shown in Table 6. FIG. 6 illustrates the zeta potential curve based on the data presented in Table 6.

TABLE 6

| Polymer D g/g clay | pH | Z.P. (mv) |
|---|---|---|
| 0 | 6.3 | −43.9 |
| 0.00388 | | +13.5 |
| 0.00776 | | +21.4 |
| 0.01163 | | +25.7 |
| 0.01551 | 6.55 | +27.4 |
| 0.01939 | 6.5 | +29.6 |
| 0.02327 | | +29.4 |
| 0.02715 | | +27.3 |
| 0.03103 | | +27.2 |
| 0.03490 | | +30.1 |
| 0.03878 | | +30.8 |
| 0.04266 | | +31.8 |

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

What I claim is:

1. A cationic filler or pigment dispersion comprising (a) a filler or pigment selected from the group consisting of kaolins, bentonites, titanium dioxide, calcium carbonate, synthetic amorphous silicas and synthetic amorphous silicoaluminates, and (b) a water soluble cationic polymer having from 30 to 80% cyclic quaternary groups selected from the group consisting of four membered cyclic quaternary azetidinium ions containing the structure

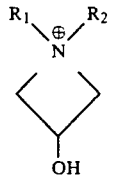

where $R_1$ and $R_2$ are residues of the polymer chain, and five membered cyclic quaternary ions having the structure

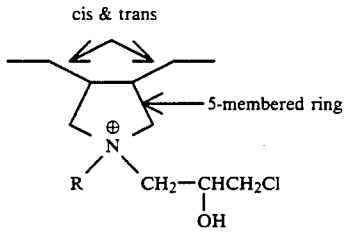

where R is a $C_1$ to $C_5$ alkyl group, said cationic polymers containing four membered cyclic azetidinium ions being prepared by reacting epichlorohydrin with a compound selected from the group consisting of i) a polyalkylenepolyamine, ii) an aminopolyamide derived from adipic acid and diethylenetriamine, and iii) the condensate derived from reaction of diethylenetriamine with cyanoquanidine, and said cationic polymers containing five membered cyclic quaternary ions being prepared by reacting epichlorohydrin with methyldiallylamine.

2. A dispersion as described in claim 1 wherein said five membered cyclic quaternary ion contains a $C_1$–$C_3$ alkyl group for R.

3. A dispersion as described in claim 2 wherein said water soluble cationic polymer comprises the reaction product of epichlorohydrin with a polymer having from 50 to 80% cyclic quaternary groups, selected from the group described in claim 1.

4. A dispersion as described in claim 3 wherein said dispersion is about 20 to 60 wt. % solids of said filler or pigment and about 0.1 to 8 wt. % of said water soluble cationic polymer based on the pigment or filler.

5. A dispersion as described in claim 4 wherein said clay is kaolin.

6. A dispersion as described in claim 4 wherein said clay is bentonite.

7. A dispersion as described in claim 4 wherein said water soluble cationic polymer comprises the reaction product of BHMT and epichlorohydrin in which the ratio of epichlorohydrin to BHMT is from 2.5/1 to 7.5/1.

8. A dispersion as described in claim 4 wherein said water soluble cationic polymer comprises the reaction product of methyldiallylamine and epichlorohydrin.

9. A dispersion as described in claim 6 wherein said water soluble cationic polymer comprises the reaction product BHMT and epichlorohydrin in which the ratio of epichlorohydrin to BHMT is from 2.5/1 to 7.5/1.

10. A dispersion as described in claim 6 wherein said water soluble cationic polymer comprises the reaction product of methyldiallylamine and epichlorohydrin.

11. A cationic filler or pigment dispersion comprising (a) about 20 to 60 wt. % solids of a filler or pigment selected from the group consisting of kaolins, bentonites, titanium dioxide, calcium carbonate, synthetic amorphous silicas and synthetic amorphous silicoaluminates, and (b) about 0.1 to 8 wt. % based on filler or pigment of a water soluble cationic polymer comprising the reaction product of epichlorohydrin and an amine selected from the group consisting of BHMT and methyl diallylamine wherein said amine comprises about 50 to 80% cyclic quaternary groups.

12. A cationic filler or pigment dispersion as described in claim 11 wherein said filler or pigment comprises a colloidal aluminum silicate clay.

13. A dispersion as described in claim 12 wherein said clay is kaolin.

14. A dispersion as described in claim 12 wherein said clay is bentonite.

15. A dispersion as described in claim 12 wherein said polymer comprises the reaction product of BHMT and epichlorohydrin in which the ratio of epichlorohydrin to BHMT is from 2.5/1 to 7.5/1.

16. A dispersion as described in claim 12 wherein said polymer comprises the reaction product of methyldiallylamine and epichlorohydrin.

17. A dispersion as described in claim 13 wherein said polymer comprises the reaction product of BHMT and epichlorohydrin in which the ratio of epichlorohydrin to BHMT is from 2.5/1 to 7.5/1 and said polymer is resent from about 0.1 to about 6 wt. % based on clay.

18. A dispersion as described in claim 13 wherein said polymer comprises the reaction product of methyldiallylamine and epichlorohydrin and is present from about 0.1 to about 4 wt. % based on clay.

19. A dispersion as described in claim 14 wherein said polymer comprises the reaction product of BHMT and epichlorohydrin in which the ratio of epichlorohydrin to BHMT is from 2.5/1 to 7.5/1.

20. A dispersion as described in claim 14 wherein said polymer comprises the reaction product of methyldiallylamine and epichlorohydrin.

21. A cationic filler or pigment dispersion as described in claim 11 wherein said pigment comprises titanium dioxide.

22. A dispersion as described in claim 21 wherein said polymer comprises about 0.1 to 2 wt. % based on pigment of the reaction product of BMHT and epichlorohydrin in which the ratio of epichlorohydrin to BHMT is from 2.5/1 to 7.5/1.

23. A dispersion as described in claim 21 wherein said polymer comprises about 0.2 to 5 wt. % based on pigment of the reaction product of methyldiallylamine and epichlorohydrin.

24. A cationic filler or pigment dispersion as described in claim 11 wherein said filler comprises calcium carbonate.

25. A dispersion as described in claim 24 wherein said polymer comprises about 0.4 to 8 wt. % based on filler of the reaction product of BHMT and epichlorohydrin in which the ratio of epichlorohydrin to BHMT is from 2.5/1 to 7.5/1.

26. A dispersion as described in claim 24 wherein said polymer comprises the reaction product of methyldiallylamine and epichlorohydrin.

27. A cationic filler or pigment dispersion as described in claim 11 wherein said filler is selected from the group consisting of silicas and silicoaluminates.

28. A dispersion as described in claim 27 wherein said polymer comprises about 0.2 to 2 wt. % based on filler of the reaction product of BHMT and epichlorohydrin in which the ratio of epichlorohydrin to BHMT is from 2.5/1 to 7.5/1.

29. A dispersion as described in claim 27 wherein said polymer comprises the reaction product of methyldiallylamine and epichlorohydrin.

30. A process for cationizing fillers or pigments for use in papermaking processes comprising adding an effective amount of water soluble cationic polymer comprising the reaction product of epichlorohydrin with a compound selected from the group consisting of four membered cyclic quaternary azetidinium ions containing the structures

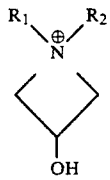

where $R_1$ and $R_2$ are residues of the polymer chain, and five membered cyclic quaternary ions having the structure

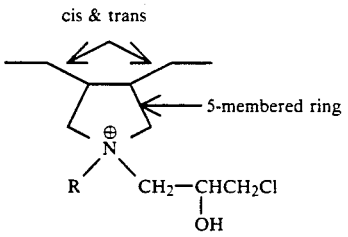

where R is a $C_1$ to $C_5$ alkyl group; to a filler or pigment selected from the group consisting of kaolin, bentonite, titanium dioxide, calcium carbonate, synthetic amorphous silicas and silicoaluminates.

31. A process as described in claim 30 wherein said five membered cyclic quaternary ion contains a $C_1$–$C_3$ alkyl group for R.

32. A process as described in claim 31 comprising adding an effective amount of a water soluble cationic polymer selected from the group consisting of the reaction product BHMT and epichlorohydrin in which the ratio of epichlorohydrin to BHMT is from 2.5/1 to 7.5/1 and the reaction product of methyldiallylamine and epichlorohydrin copolymer to a filler or pigment selected from the group consisting of kaolin, bentonite, titanium dioxide, calcium carbonate, synthetic amorphous silicas and silicoaluminates.

33. A process as described in claim 32 wherein about 0.1 to 8 wt. % based on filler or pigment of said polymer is added to the filler or pigment.

34. A process as described in claim 33 comprising adding about 0.1 to 6 wt % based on filler of said water soluble cationic polymer comprising the reaction product of BHMT and epichlorohydrin in which the ratio of epichlorohydrin to BHMT is from 2.5/1 to 7.5/1 to a kaolin clay filler.

35. A process as described in claim 34 wherein said filler is bentonite.

36. A process as described in claim 33 comprising adding about 0.1 to 4 wt. % based on filler of said water soluble cationic polymer comprising the reaction product of methyldiallylamine and epichlorohydrin to kaolin clay.

37. A process as described in claim 36 wherein said filler is bentonite.

38. A process as described in claim 33 comprising adding about 0.1 to 2 wt. % based on pigment of the reaction product of BHMT and epichlorohydrin in which the ratio of epichlorohydrin to BHMT is from 2.5/1 to 7.5/1 to titanium dioxide.

39. A process as described in claim 33 comprising adding about 0.2 to 5 wt. % based on calcium carbonate of the reaction product of methyldiallylamine and epichlorohydrin.

40. A process as described in claim 33 comprising adding the reaction product of methyldiallylamine and epichlorohydrin to a calcium carbonate filler.

41. A process as described in claim 40 comprising adding about 0.4 to 8 wt. % based on calcium carbonate of the reaction product of BHMT and epichlorohydrin in which the ratio of epichlorohydrin to BHMT is from 2.5/1 to 7.5/1.

42. A process as described in claim 33 comprising adding the reaction product of methyldiallylamine and epichlorohydrin to a filler selected from the group consisting of silicas and silicoaluminates.

43. A process as described in claim 42 comprising adding about 0.2 to 2 wt. % based on filler of the reaction product of BHMT and epichlorohydrin in which the ratio of epichlorohydrin to BHMT is from 2.5/1 to 7.5/1.

* * * * *

UNITED STATES PATENT AND TRADEMARK OFFICE

CERTIFICATE OF CORRECTION

PATENT NO. : 5,169,441

DATED : DECEMBER 8, 1992

INVENTOR(S) : RODRIGUE V. LAUZON

It is certified that error appears in the above-identified patent and that said Letters Patent is hereby corrected as shown below:

Col. 9, line 62, "resent" should read — present —.

Signed and Sealed this

Fourth Day of July, 1995

*Attest:*

BRUCE LEHMAN

*Attesting Officer*

*Commissioner of Patents and Trademarks*